US007971824B2

(12) United States Patent
Van de Rostyne

(10) Patent No.: US 7,971,824 B2
(45) Date of Patent: Jul. 5, 2011

(54) FLYING OBJECT

(75) Inventor: Alexander Jozef Magdalena Van de Rostyne, Bornem (BE)

(73) Assignee: Silverlit Limited, Causeway Bay (HK)

( * ) Notice: Subject to any disclaimer, the term of this patent is extended or adjusted under 35 U.S.C. 154(b) by 419 days.

(21) Appl. No.: 11/836,652

(22) Filed: Aug. 9, 2007

(65) Prior Publication Data

US 2009/0039207 A1 Feb. 12, 2009

(51) Int. Cl.
*B64C 3/14* (2006.01)
*B64C 3/32* (2006.01)
*B64C 39/10* (2006.01)

(52) U.S. Cl. ..... 244/35 R; 244/91; 446/57

(58) Field of Classification Search ..... 446/56, 446/57, 58, 59, 60, 61, 34; 244/35 R, 45 R, 244/55, 99.11, 23 C, 54, 12.6, 36, 99.1, 91; 416/146 R See application file for complete search history.

(56) References Cited

U.S. PATENT DOCUMENTS 934,771 A * 9/1909 Turnbull ..... 244/35 R
1,043,079 A * 11/1912 von Dreden et al. ..... 244/35 R
1,470,017 A 10/1923 Lougheed
1,523,994 A * 1/1925 Myers ..... 244/35 R
4,941,803 A 7/1990 Wainauski
6,568,980 B2 * 5/2003 Barthold ..... 446/57

OTHER PUBLICATIONS

Combined Search and Examination Report dated Mar. 4, 2008, from UK Application No. GB0723979.1.

* cited by examiner

*Primary Examiner* — Tien Dinh
*Assistant Examiner* — Richard R Green
(74) *Attorney, Agent, or Firm* — Greenberg Traurig, LLP

(57) ABSTRACT

A flying object wing has a leading edge and a trailing edge and an upper and a lower surface between the edges. A portion between the leading edge and trailing edge provides an upper surface which has a curved shape. From the leading part of the upper surface towards the mid part of the surface there is a concave shape. The lower surface has a curved shape such that from the leading part of the upper surface towards the mid part of the surface there is a convex shape. A transverse aperture in the surfaces of the wing accommodates a propeller for creating thrust for forward flight. The blades of the propeller turn in a plane transverse to a line between the leading edge and the trailing edge of the surface.

19 Claims, 17 Drawing Sheets

FLYING OBJECT

BACKGROUND

This disclosure relates generally to a flying object, for instance a toy flying device or aircraft. More particularly, the disclosure concerns a surface like wing that is capable of sustained flight.

The flying characteristics of flying objects are determined by the shape of the object or parts of the object. An object can be powered or be more of a glider structure. Elements such as weight, fuselage and wing shape and size determine the flying characteristics. Also, the flying object can be selectively controllable by humans, with or without the use of radio control. Known flying objects have limitations.

It is known that a flying object is a complex machine which is potentially unstable and as a result difficult to control, so that much experience is required to safely operate such flying objects without mishaps.

The disclosure provides an improved flying object capable of novel flying characteristics, maneuvers, and/or actions. The present disclosure aims to minimize one or several of the above-mentioned and other disadvantages by providing a simple solution to allow for characteristics such as slow flight and short take-off and landing distances of the flying object, such that operating the flying object becomes simpler and possibly reduces the need for long-standing experience of the pilot or user.

SUMMARY

The disclosure concerns a flying object generally. There is an air deflecting surface of the wing, and there can be a propeller operable in relation to the wing surface to facilitate the flying motion and action.

The flying object comprises a wing wherein the wing has a leading edge and a trailing edge and an upper and a lower surface between the edges, and a portion between the leading edge and trailing edge.

The upper surface can have a curved shape such that from the leading part of the upper surface towards the mid part of the surface there is a generally concave shape.

The lower surface can have a curved shape such that from the leading part of the lower surface towards the mid part of the surface there is a generally convex shape.

There is a portion between the leading edge and trailing edge. In one form, there is a transverse aperture in the surface of the wing to accommodate a propeller. In other forms, the wing is separated as more than one portion, accommodating a propeller between the portions of the wing. The propeller is for creating a force for forward flight. The propeller causes air from the front of the flying object to be drawn over the front surface towards the mid surface and pushes air over the mid surface towards the trailing edge. The blades of the propeller turn in a plane transverse to a line between the leading edge and the trailing edge of the surface.

The flying motion includes one or more of the features to:

fly slowly, for instance at a speed close to 1 m/sec.

turn in a short radius, for instance at a radius of 0.5 m.

be automatically-stabilizing, so as to come back to straight and level flight essentially by itself;

be able to optionally take off on its own power in a short distance, for instance a distance of 50 cm; and be able to land in a short distance, for instance a distance of 30 cm or less as associated with an almost vertical parachute-like descent.

Because of these elements, the flying object can be flown in tight places, for instance a corridor or home.

In a toy mode, the flying object can, for instance, fly indoors. The flying object can take off from a kitchen table and land on the dining room table. It is useable by novice fliers, and can also bring lots of fun to the more experienced pilot. If a forward action such as tossing is desired, this is also possible.

The flying object in one form is a remote controlled airplane. In particular, but not exclusively it is related to a toy flying object, and in particular to a remote-controlled model flying object or a toy flying object.

The flying object includes a body which includes a wing-like element, and a propeller. The propeller provides a lateral thrust or force to keep the flying object in the air and to move the flying object in required directions.

In general, the stability of a flying object includes the result of the interaction between the rotation of the propeller blades of the propeller and the wing of the body. The stability of the flying object is influenced by the rotational speed of the propeller. The weight and size of the blades in relation to the rest of the flying object also influences the stability.

There are left and right wing portions of the wing which are directed transversely of a longitudinal axis of the flying object body. A fin is directed upwardly at the fin area of the flying object. Multiple fins can be used. Fins that are directed downwardly on the flying object can also be used for additional directional stability at high incidence. The fin may be slanted at an angle or directly perpendicular to the wing. The shape of the fin can vary, for instance forward pointing fins, depending on desired aerodynamics, stability, appearance, and controlling of the flying object.

DRAWINGS

In order to further explain the characteristics of the disclosure, the following embodiments of an improved flying object according to the disclosure are given as an example only, without being limitative in any way, with reference to the accompanying drawings. The features and objects of the present disclosure will become more apparent with reference to the following description taken in conjunction with the accompanying drawings where like reference numerals denote like elements and in which.

Figure 13:
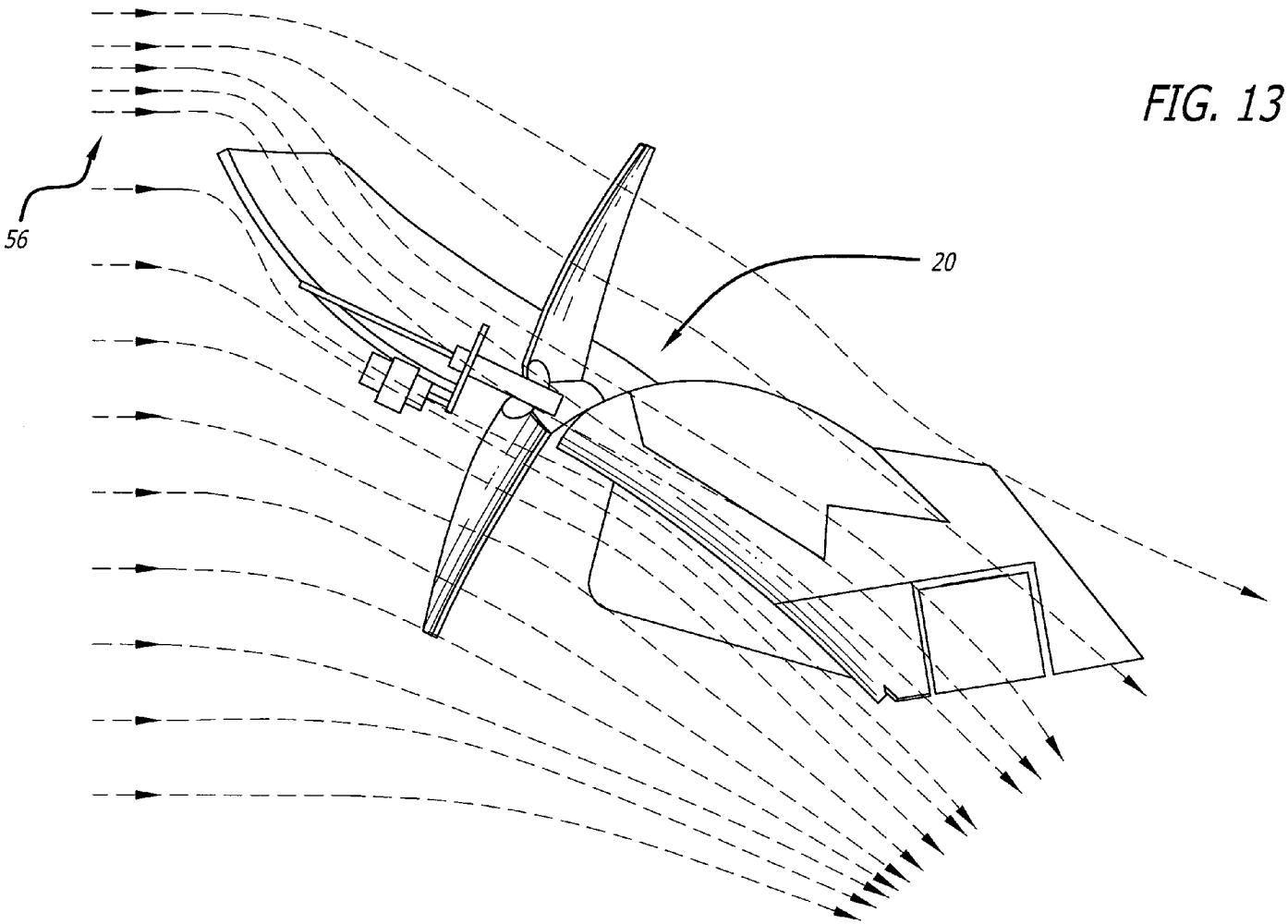
Figure 14A:
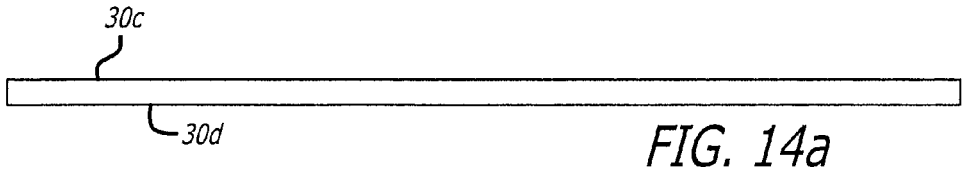
Figure 14B:
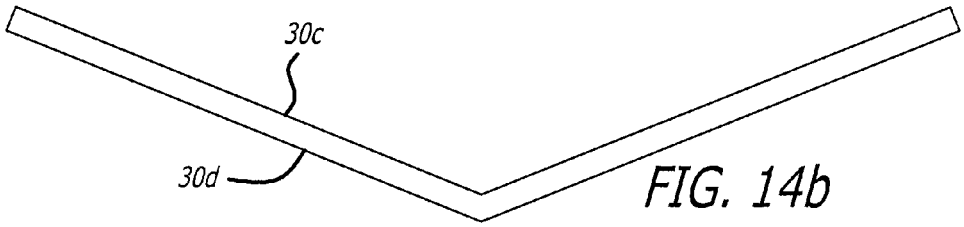
Figure 14C:
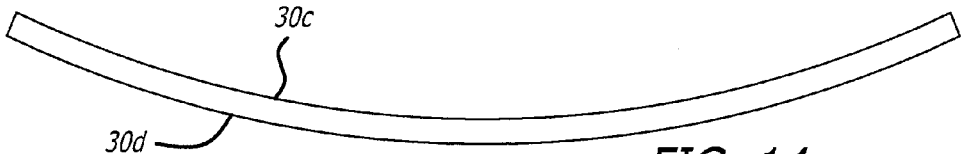
Figure 14D:
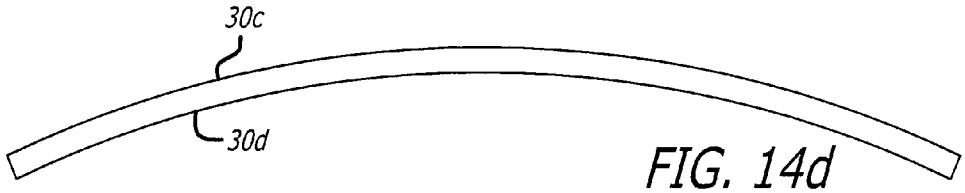
Figure 14E:
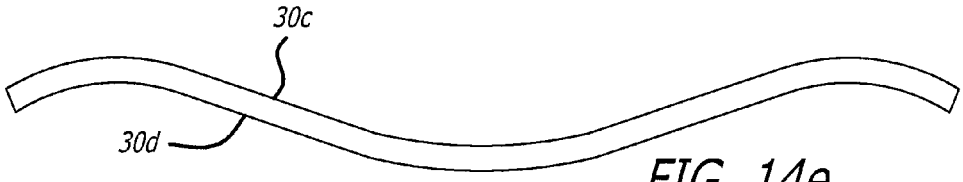
Figure 15:
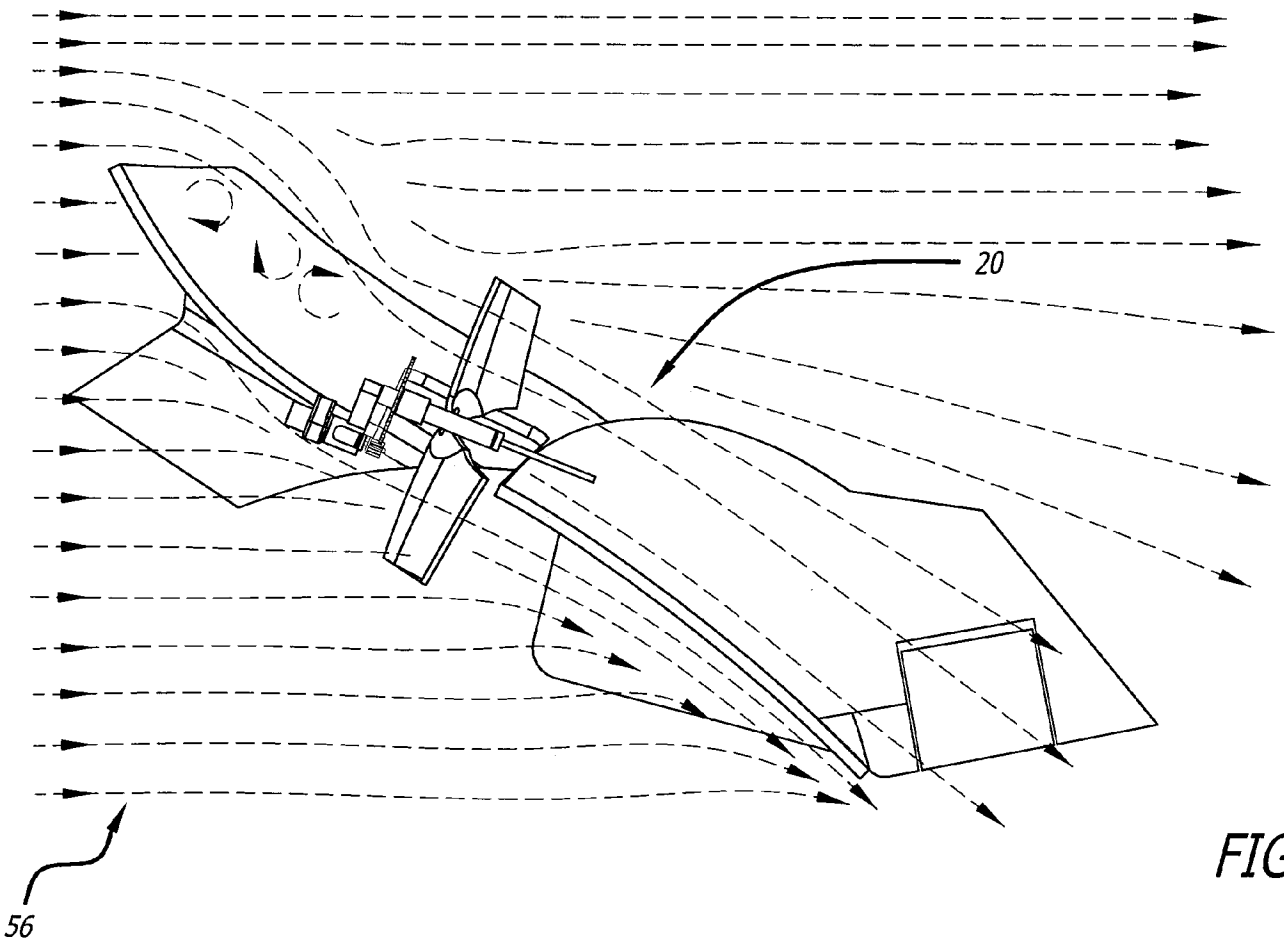
Figure 16:
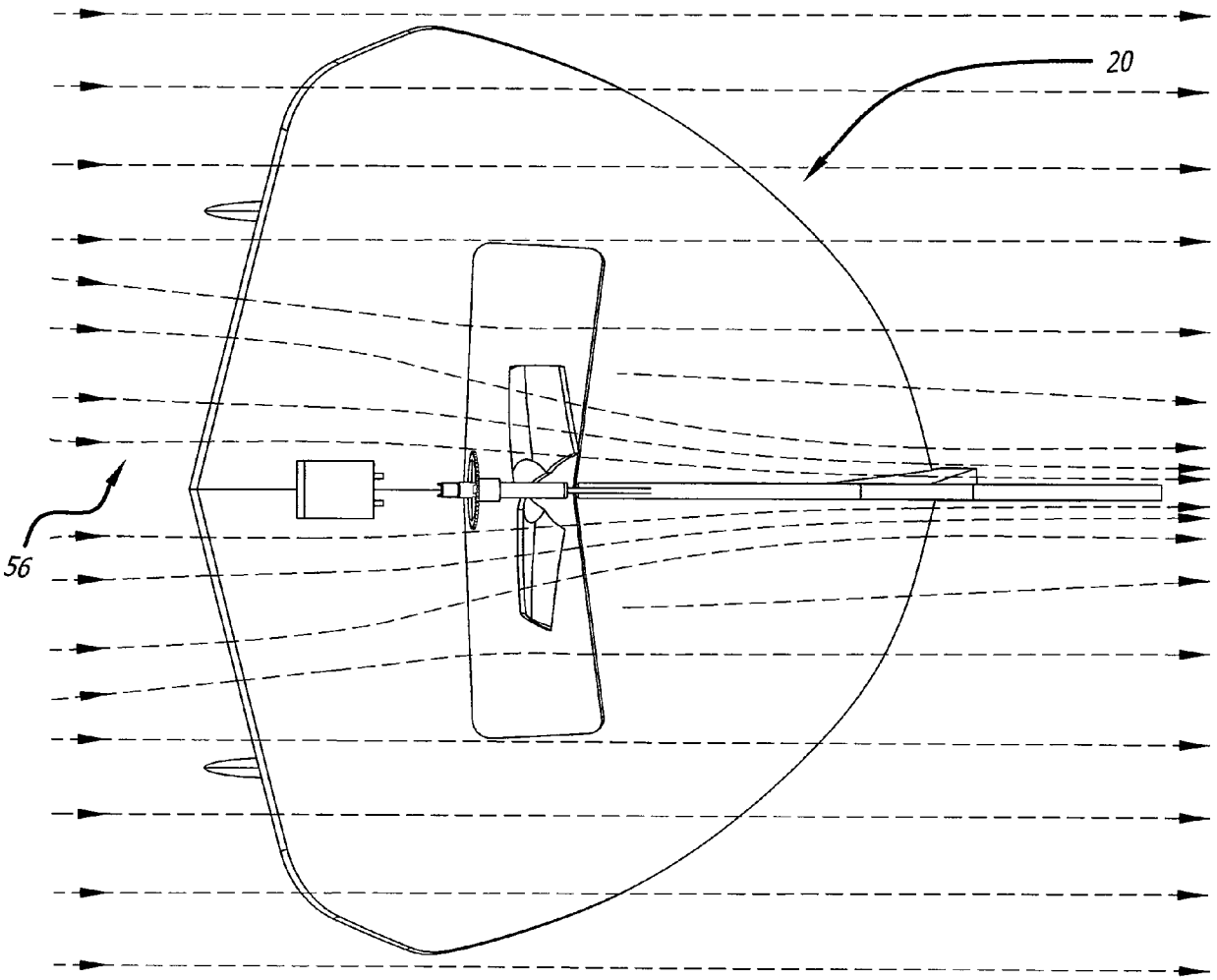
Figure 17:
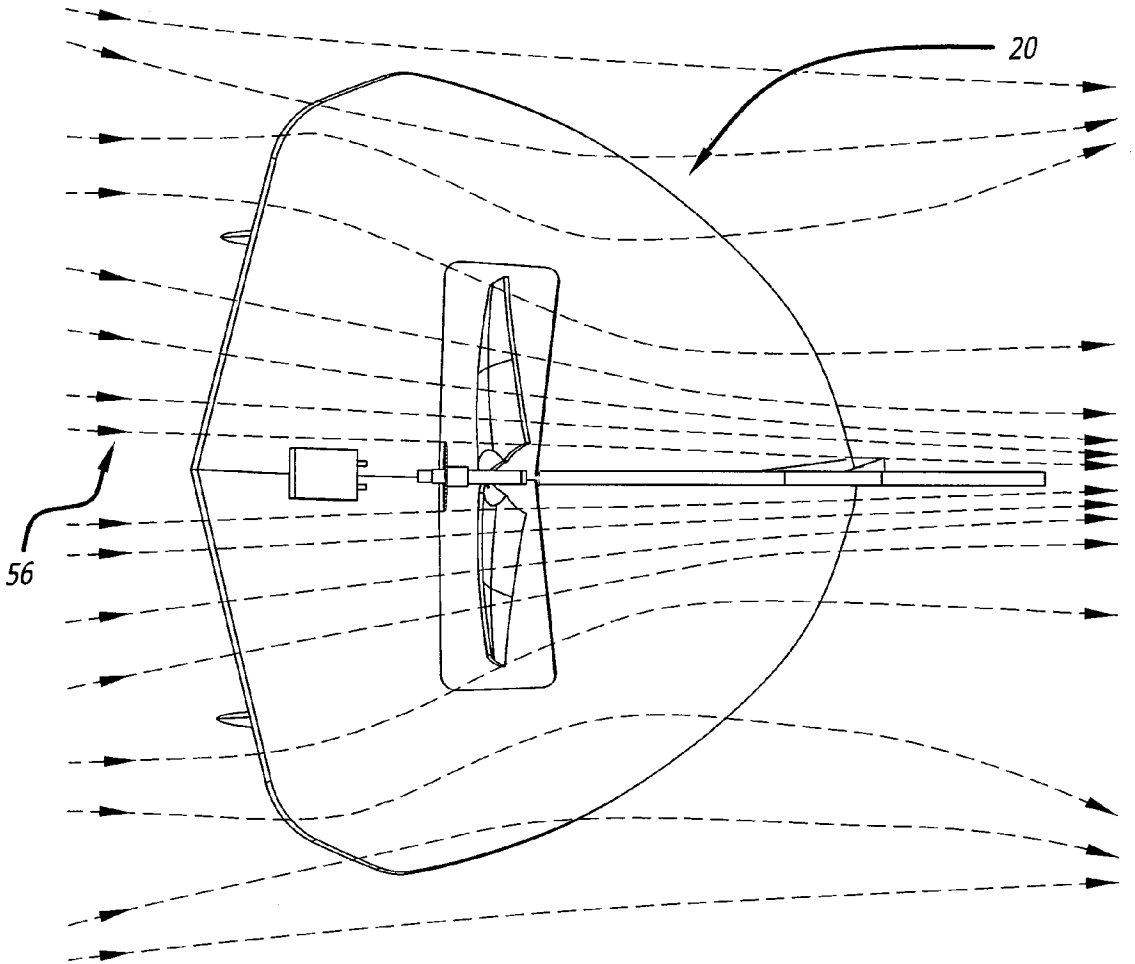

FIGS. 9 to 12*b* are different cross sectional side view representative profiles of the wing;

FIG. 13 is a side view showing airflow across a flying object;

FIGS. 14*a*-14*e* are different frontal view representative profiles of the wing;

FIG. 15 is a side view showing airflow across a flying object with a small propeller;

FIG. 16 is a top view showing airflow across a flying object with a small propeller;

FIG. 17 is a top view showing airflow across a flying object with a large propeller.

DETAILED DESCRIPTION

Figure 9:
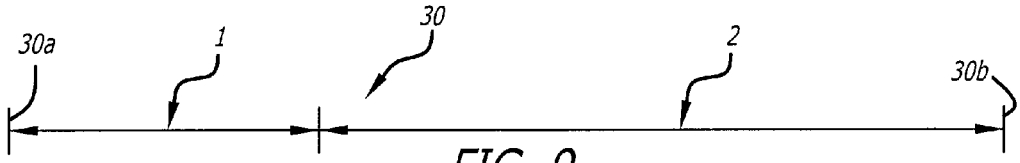

A flying object 20 comprises a wing 30 wherein the wing 30 has a leading edge 30*a* and a trailing edge 30*b* and an upper surface 30*c* and a lower surface 30*d* between the edges 30*a* and 30*b*. As shown in FIG. 9, the wing 30 includes collectively portions 1 and 2 between the leading edge 30*a* and trailing edge 30*b*. Illustrated in FIGS. 9*a*-9*c*, the upper surface 30*c* has a curved shape such that from the leading part 30*a* of the upper surface 30*c* towards the mid part 30*e* of the wing (the interface of the portions 1 and 2) there is a generally concave shape. The lower surface 30*d* has a curved shape such that from the leading part 30*a* of the surface towards the mid part 30*e* of the wing there is a generally convex shape.

Figure 9A:
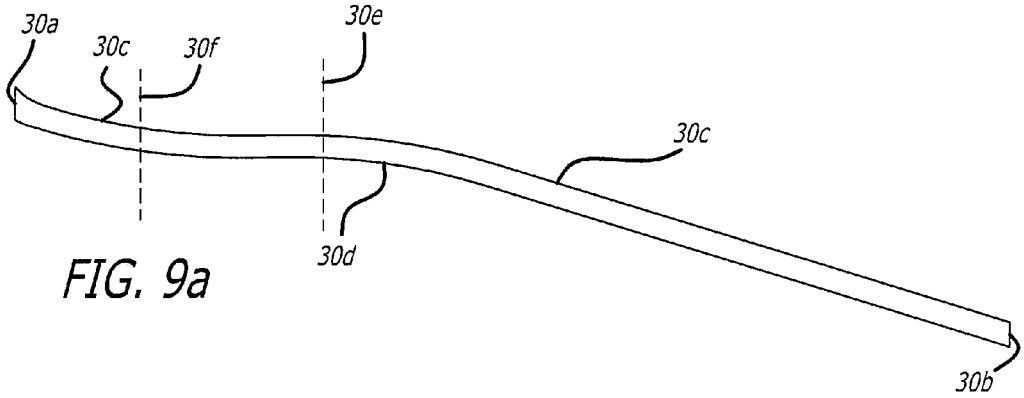
Figure 9B:
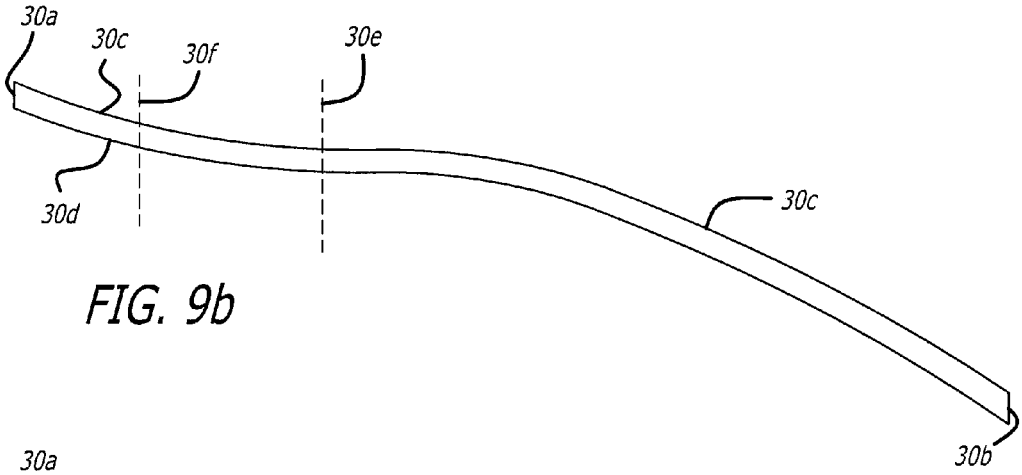

Relative to a substantially horizontal line of flight, the portion from the leading edge 30*a* towards a portion of inflexion 30*f* in the direction of the mid portion 30*e*, is a relatively larger inclination than the portion from the portion of inflexion 30*f* to the mid portion 30*e*. This is illustrated in FIGS. 9*a* to 9*c*

Figure 9C:
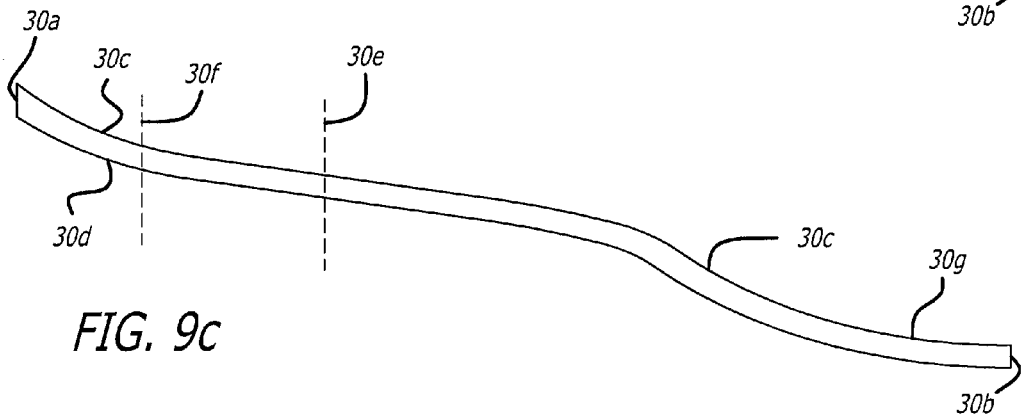
Figure 10:
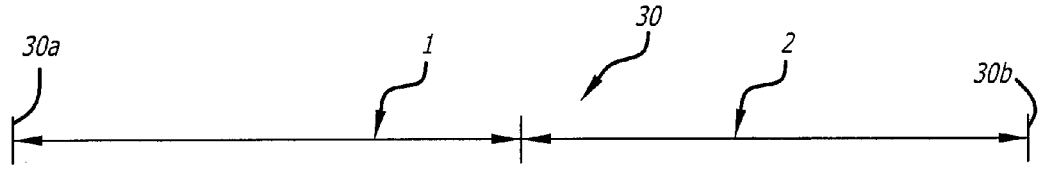
Figure 10A:
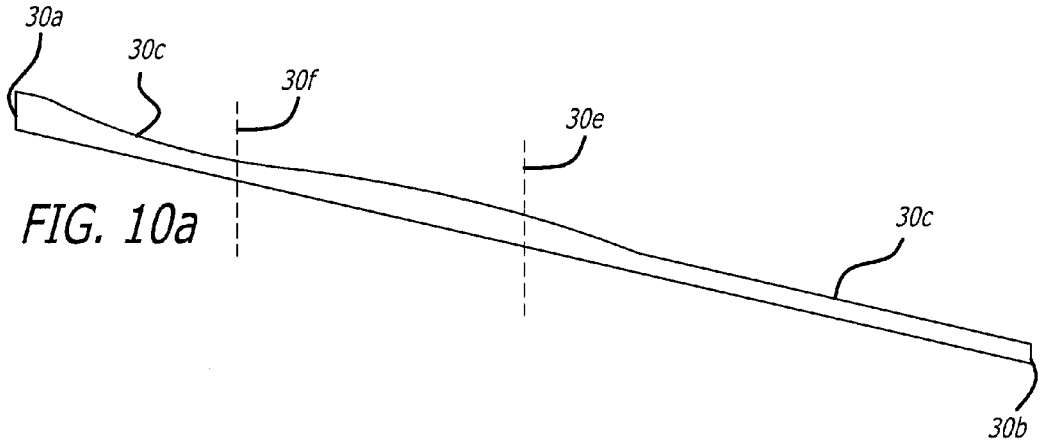
Figure 10B:
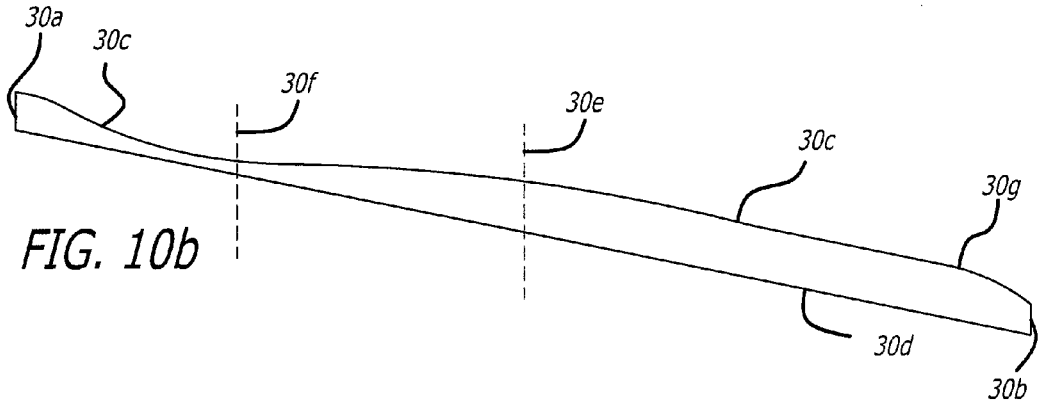
Figure 10C:
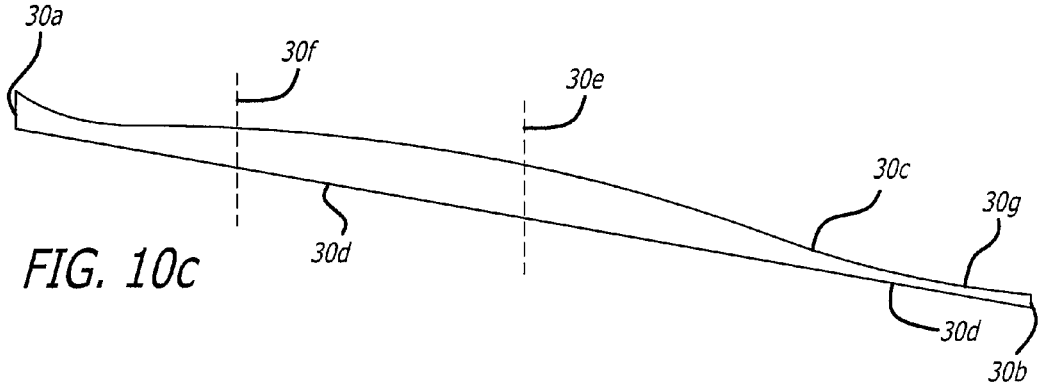
Figure 11:
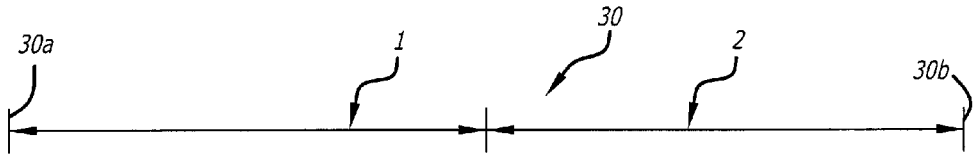
Figure 11A:
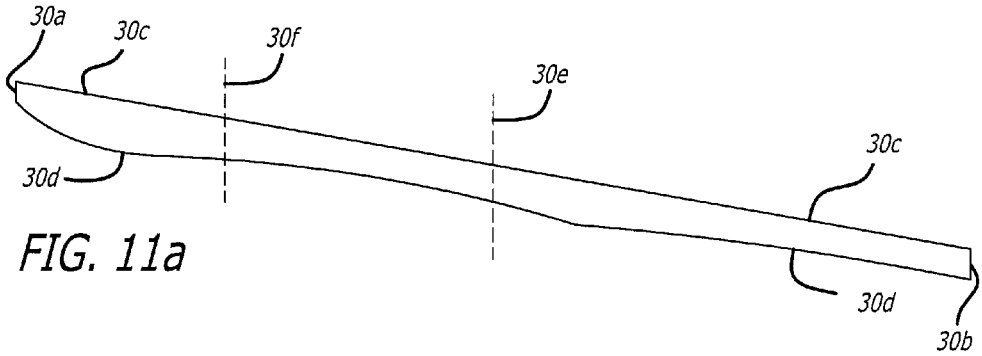
Figure 11B:
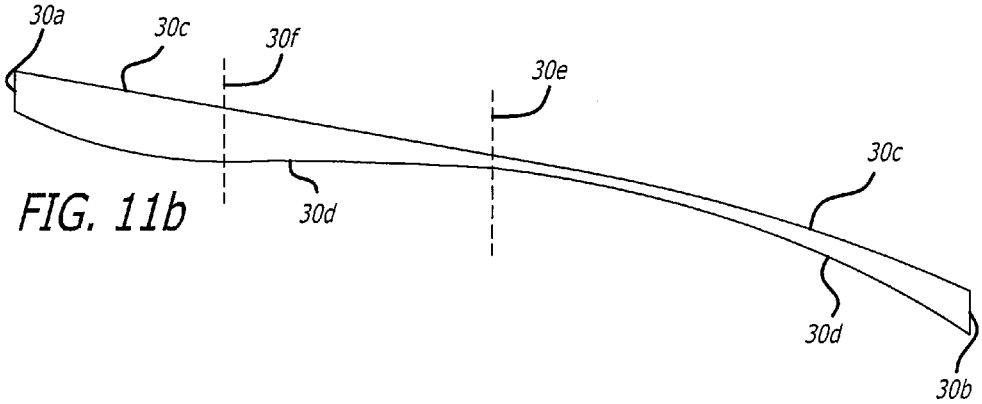
Figure 11C:
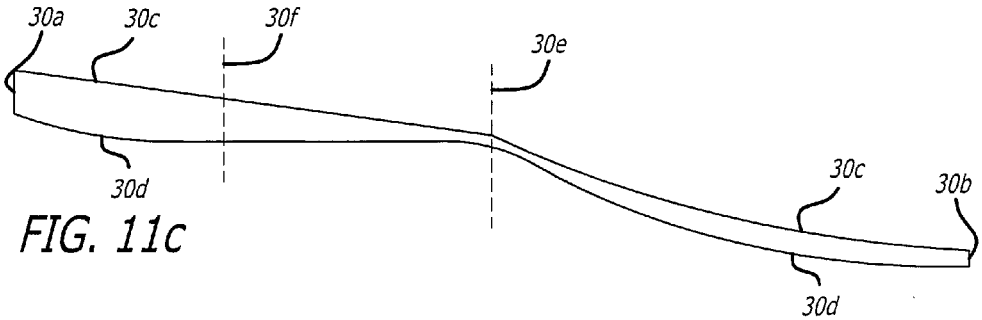

In portion 2 between the mid section 30*e* and trailing edge 30*b*, the top surface 30*c* can have different shapes, such as a relatively flat shape (FIGS. 9*a*, 10*a* and 11*a*), convex curved shape (FIGS. 9*b*, 10*b* and 11*b*), or an upper surface 30*g* having selectively a convex or concave curved shape (FIGS. 9*c*, 10*b* and 10*c*). The bottom surface 30*d* can also have different shapes independent of the top surface 30*c*: In FIGS. 10*a* to 10*c* the shape is flat. In FIGS. 11*a* to 11*c* the shape is concave.

Figure 12A:
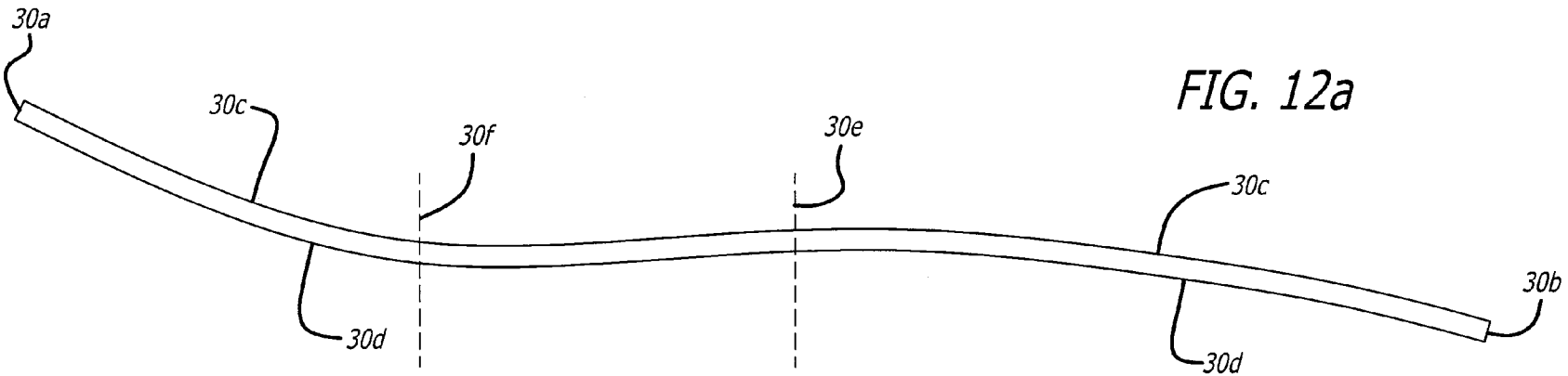
Figure 12B:
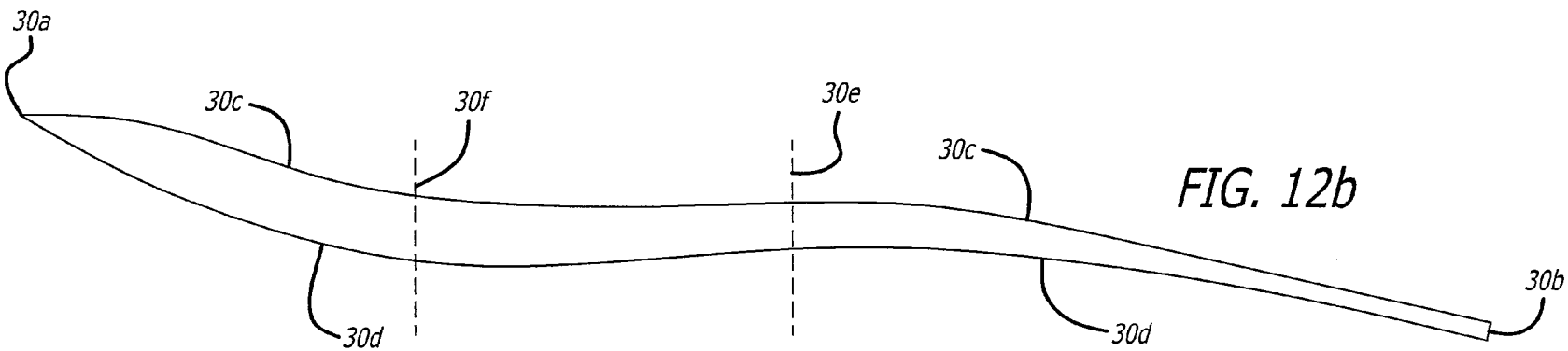

As illustrated in FIG. 12*a*, the upper surface 30*c* and the lower surface 30*d* can be parallel to each other, resulting in a uniform width of the wing 30 throughout. In other embodiments, the upper surface 30*c* and the lower surface 30*d* are not parallel to each other, resulting in some sections of the wing wider than other sections. In one particular embodiment, as shown in FIG. 12*b*, the middle of the wing is thicker to allow for increased stiffness and structural strength of the wing, as well as enhanced airflow. The leading edge 30*a* and trailing edge 30*b* can be flat, sharp or rounded depending on desired aerodynamics. The trailing edge 30*b* may also be tapered, allowing for better airflow and higher lift.

The trailing edge 30*b* can be relatively below to the forward edge. The left and right wing sections can also be dihedral, each section angled upwardly. The angles of the wing leading edge and the angles of the left and right wing above horizontal level may vary depending on desired lateral stability.

Furthermore, as illustrated in FIGS. 14*a*-14*e*, the shape of wing 30 directed transversely of a longitudinal axis of the flying object body can have different shapes, such as a flat shape (FIG. 14*a*), V-shape (FIG. 14*b*), concave shape (FIG. 14*c*), convex shape (FIG. 14*d*), recurve bow shape (FIG. 14*e*), or other shapes and combinations of shapes.

In another form, a flying object 20 comprises a wing 30 where the wing 30 has a leading edge 30*a* and a trailing edge 30*b* and an upper surface 30*c* and a lower surface 30*d* between the edges 30*a* and 30*b*. There is a portion between the leading edge 30*a* and trailing edge 30*b*, and there is a transverse aperture 31 in the surfaces 30*c* and 30*d* of the wing 30. A propeller 9 is located in the aperture 31, and the propeller 9 is for creating a force for forward flight. Blades 25 of the propeller 9 turn in a plane 26 which is a transverse line between the leading edge 30*a* and the trailing edge 30*b* of the surfaces.

This propeller 9 can be used with one of the different wing profiles which have been described or be independent of the wing profiles. The propeller 9 is provided on a propeller head 23 which locates the propeller shaft 24 that is mounted relative to the body 22 of the flying object 20. The propeller 9 is rotatable and is driven by a motor 16 through a gear transmission 13, whereby the motor 16 is, for example, an electric motor which is powered by a battery 17. The propeller is directly connected to the rotational axis.

The propeller 9 in this case has two propeller blades 25 which are in line or practically in line, but which may just as well be composed of a larger number of propeller blades 25.

The plane 26 of rotation of the propeller blades 25 may vary relative to the plane 27 of the wing 30 and/or an aperture 31 in the wing 30. The plane of rotation 26 of the propeller 9, can be adjusted as needed, such as to allow for looping and spinning maneuvers of the flying object.

The propeller 9 causes air from the front of the flying object 20 to be drawn over the front surface 30*c* towards the mid surface or area 30*e* and pushes air over the mid surface or area 30*e* towards the trailing edge 30*b*. Though generally the propeller is located around the mid part 30*e* of the wing (the interface of the portions 1 and 2), the propeller can also be located in front or behind the mid part 30*e*.

Figure 1:
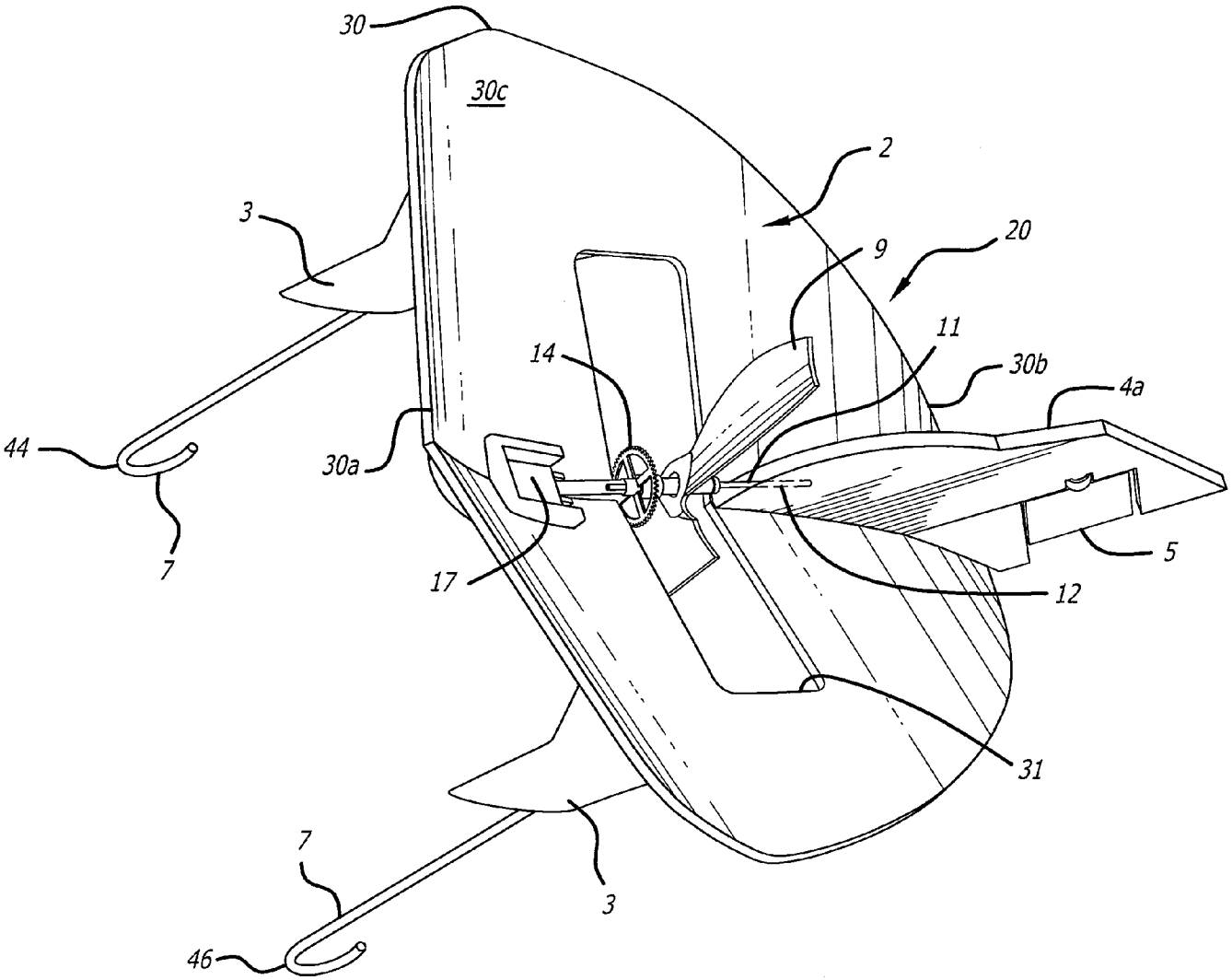
FIG. 1 is a top perspective view from the front showing the wing surface, fin and propeller of a flying object.
Figure 2:
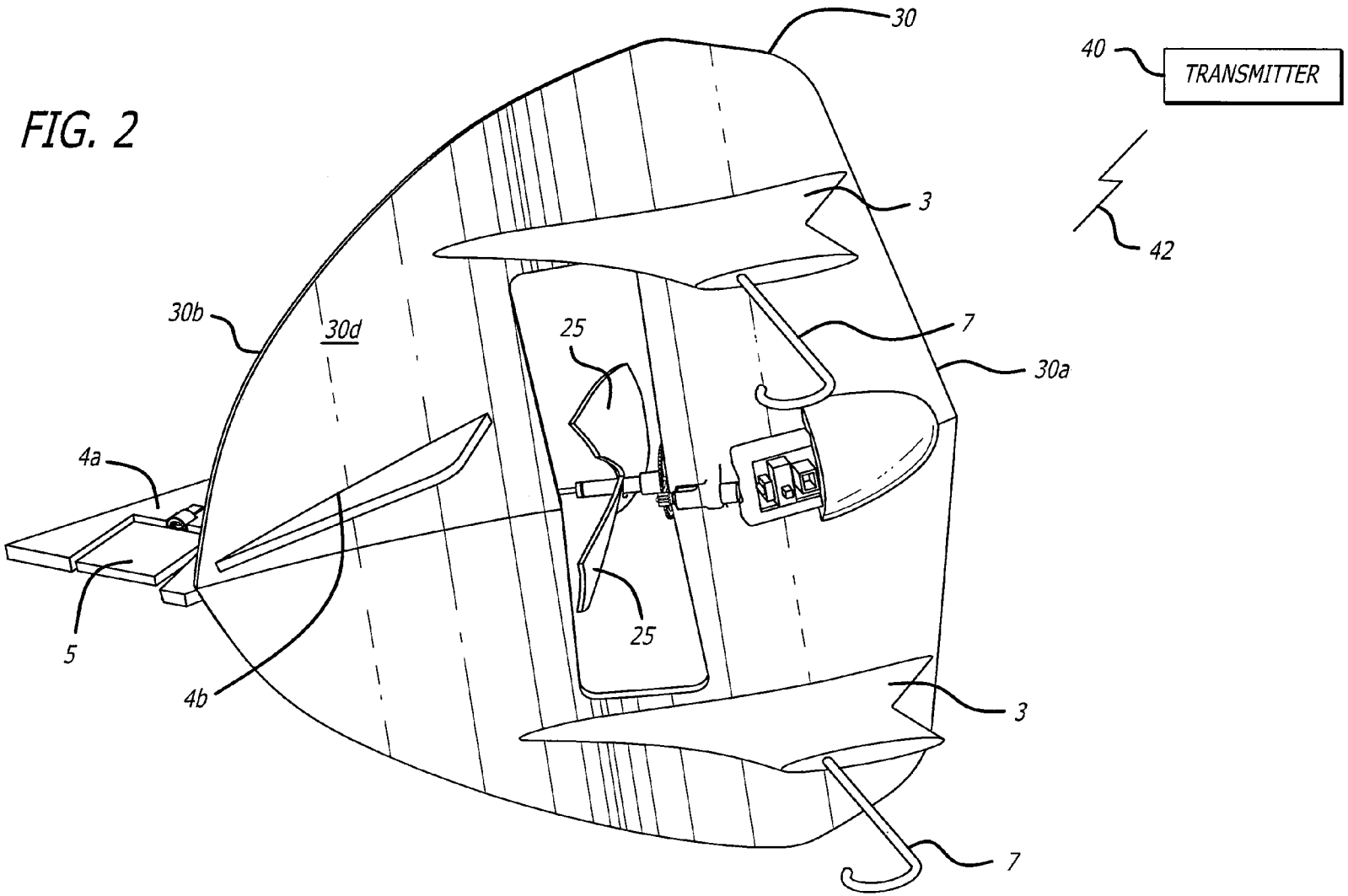
FIG. 2 is a bottom perspective view from the back of the flying object.
Figure 3:
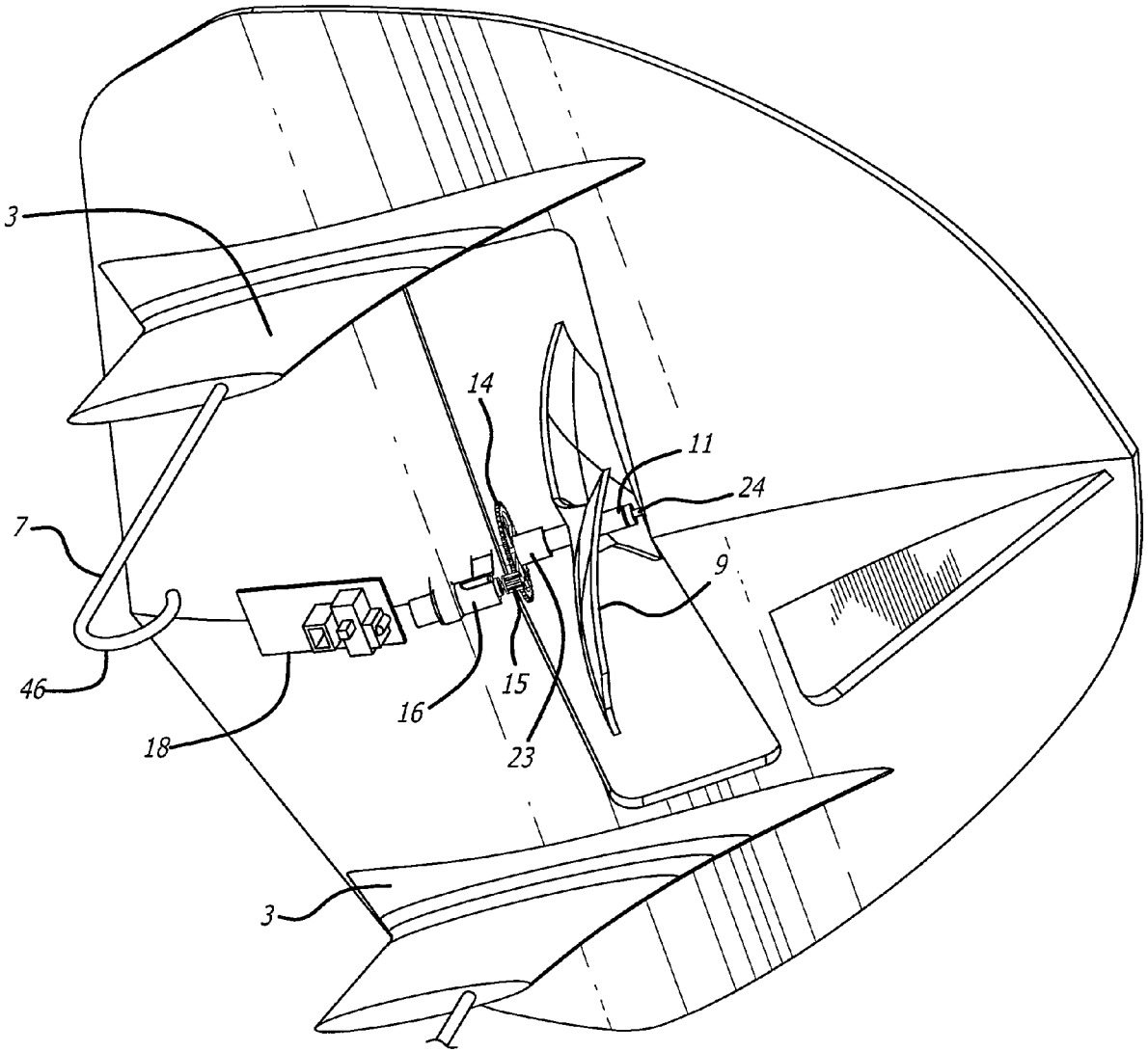
FIG. 3 is an enlarged bottom perspective view from the back of a portion of the flying object.
Figure 4:
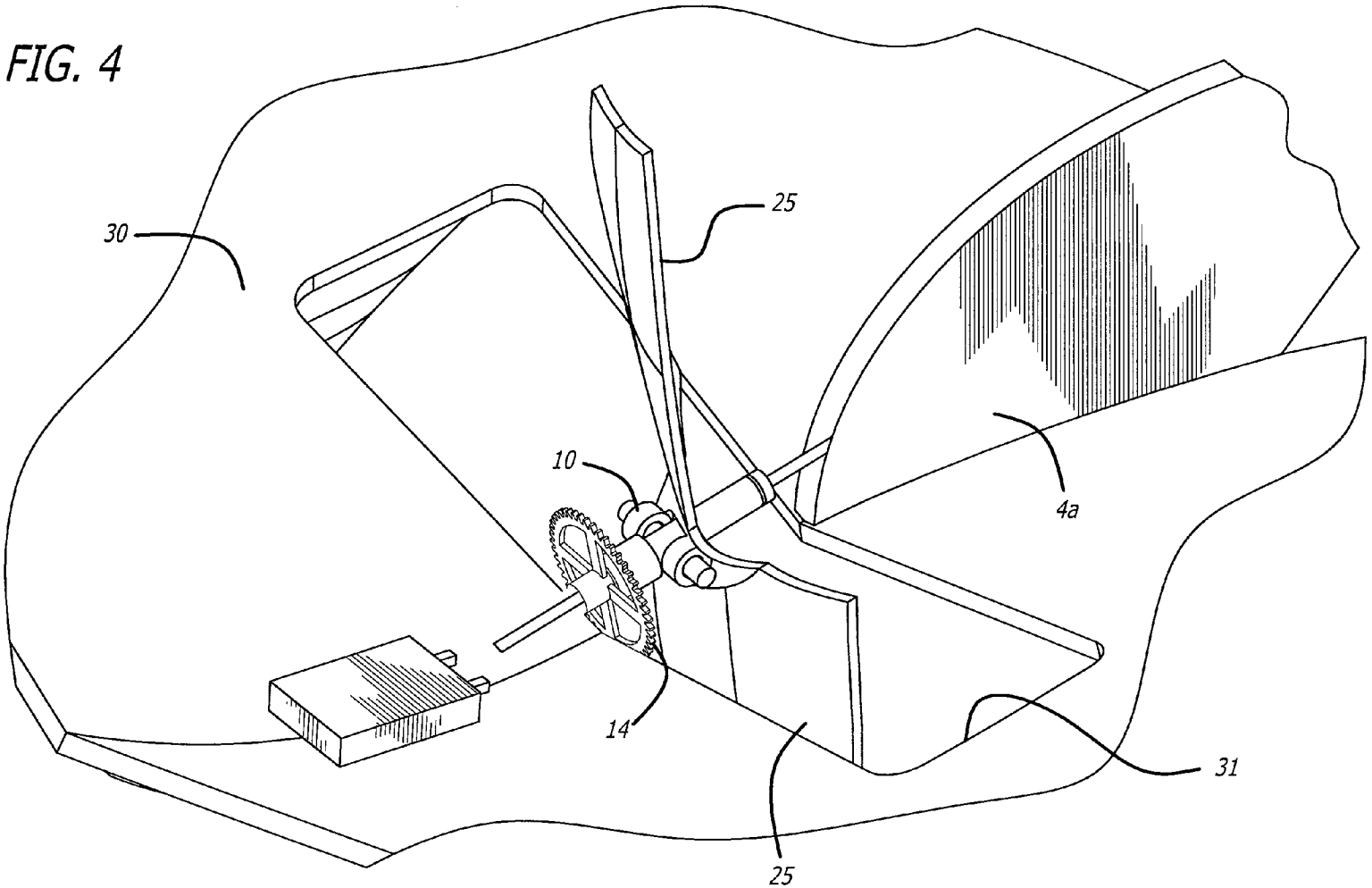
FIG. 4 is an enlarged top perspective view from the front of a portion of a flying object.
Figure 5:
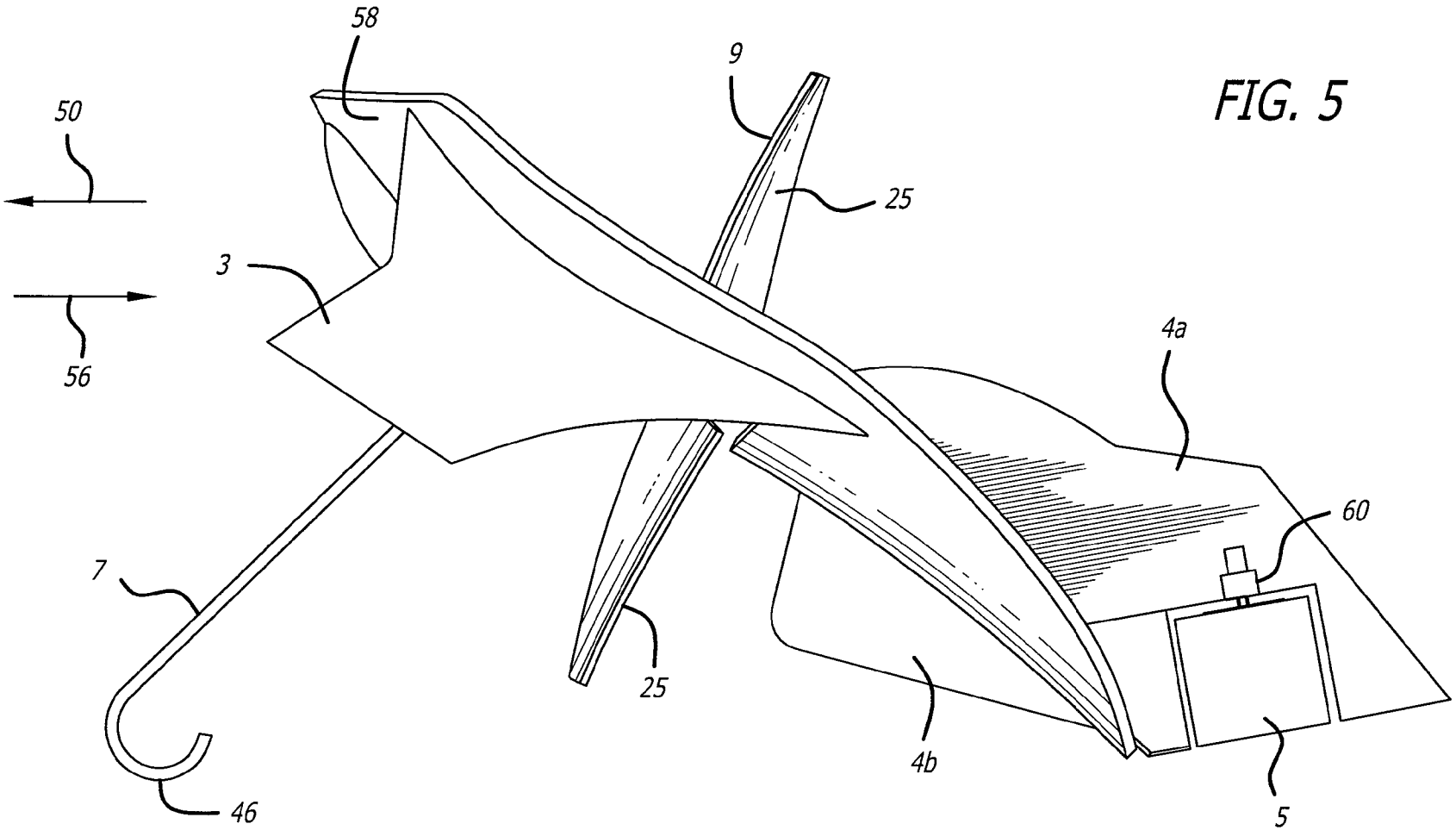
FIG. 5 is a side view showing the wing surface, fin and propeller of a flying object.
Figure 6:
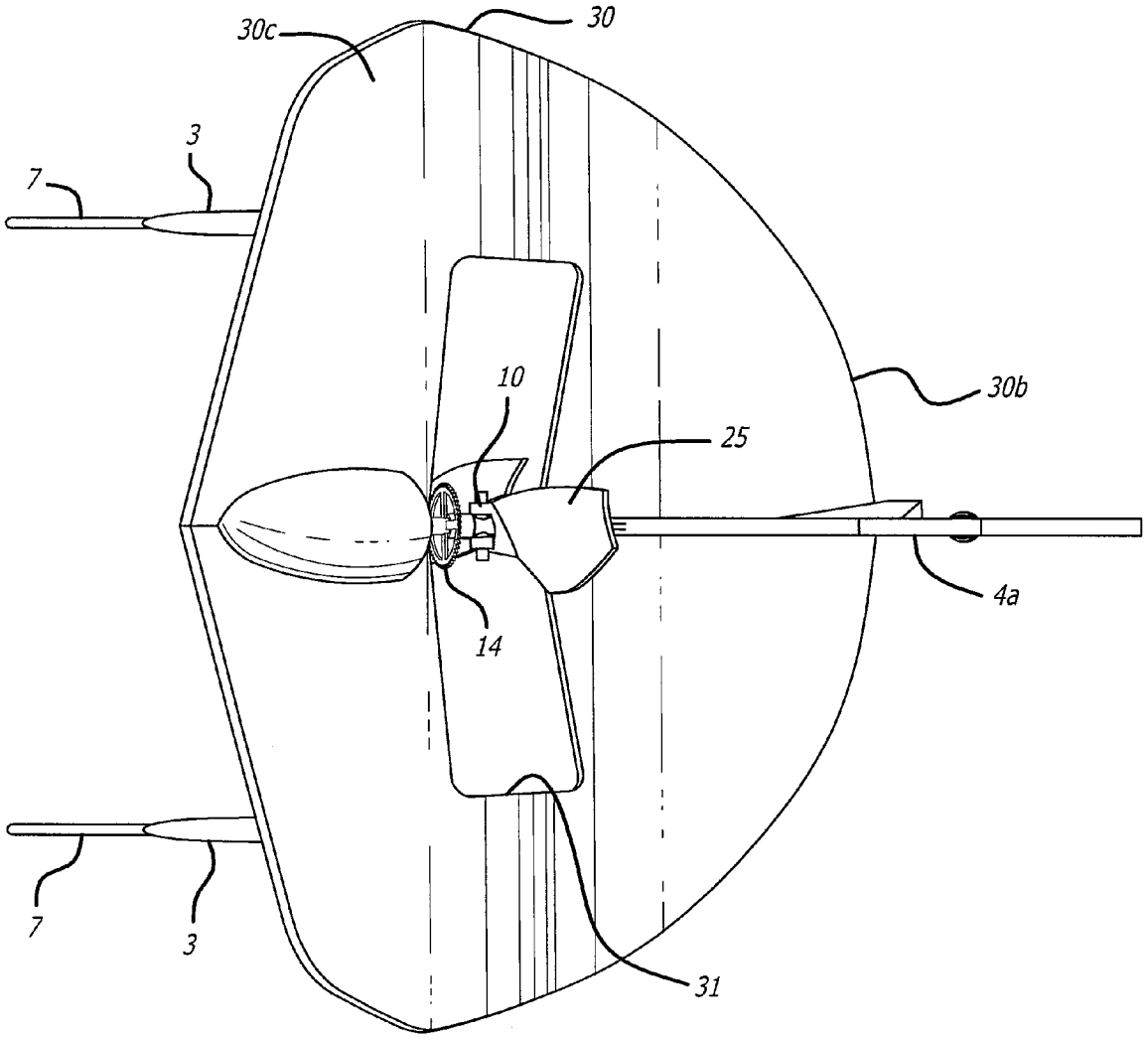
FIG. 6 is a different top perspective view from the front showing the wing surface, fin and propeller of a flying object.

The ratio between the rotational diameter of the propeller 9 and the side to side span of the wing 30 is such that the drawing effect and pushing effect increases when this ratio increases. A large ratio is preferred, though a smaller ratio may be used depending on the desired characteristics of the flying object. In one embodiment, as illustrated in FIG. 1, the ratio is slightly less than 0.5. It is also possible for the ratio to be 1 or greater.

The flying object 20 includes an upwardly fin towards the tail of the wing, and a landing gear. The landing gear is directed downwardly whereby the tips of the landing gear permit for stabilizing the flying object when on the ground. The tips of the landing gear further allow the flying object to be angled such that the flying object is at a correct incidence versus the horizontal line of flight, thereby allowing for short takeoffs.

There is a motor for rotating the propeller and controllers that receive signals from a remote transmitter for controlling the controller.

The flying object 20 is represented in the figures by way of example, and is a remote-controlled flying object which includes the wing 30. The flying object 20 is provided with a signal receiver 18, so that it can be controlled from a distance by a transmitter 40 through the means of remote control RF signal 42.

The elements of the flying object 20 include a

- front-end flying surface or portion 1 of the wing 30;
- back-end flying surface or portion 2 of the wing 30;
- front-end stabilizing surface or fin 3 on the wing 30;
- back-end upwardly directed stabilizing surfaces or fin 4*a* and lower fin 4*b* on the wing 30;
- directional control surface 5;
- up/down control surface 6;
- landing gear wires 7 mounted in stabilizing fins 3;
- control surface actuator 8;
- propeller 9;
- propeller hinge 10;
- propeller rotational axis 12 which is the same as line 11;
- gear reduction system 13 which includes the assembly of 14/15;
- main gear 14;

pinion 15;
motor 16;
battery 17;
receiver and control unit 18.

The front-end flying surface (FEFS) has a positive inclination against the flight path. The curved shape ('away from the bottom') of the FEFS causes the forward part of it to be inclined more than the backward part. The curve has its 'deep' side towards the bottom of the FEFS. The back-end flying surface (BEFS) has a positive incidence against the flighty path. It can be curved up or down, or be flat.

More details of the propeller 9 are set out. The propeller 9 need not necessarily be a rigid whole. The propeller blades 25 can also be provided on the propeller head 23. In some cases a propeller 9 can have more than two propeller blades 25. These propeller blades 25 may also be hingedly connected to the propeller head, allowing for varying blade angles influenced by various conditions, such as the propeller's speed of rotation and changes of attitude of the wing in turns or in disturbed air.

The propeller 9 aspires air from the front of the flying object along the FEFS and pushes air towards the back of the flying object along the BEFS. The propeller 9 creates a 'beam' of air flow over the flying surfaces that are substantially faster than the flight speed of the flying object, which can be an airplane. As such, this air beam contributes substantially to the aerodynamic lift force and the stability.

The flying object can fly at low speed, for instance at a speed of around 1 m/sec, and high angles of attack without stalling ('falling out of the air'). The size of this effect depends on the ratio between the rotational diameter of the propeller and the side to side span of FEFS and BEFS. The effect increases when this ratio increases. A small propeller 9 with a substantially larger span of the flying surfaces has less effect than a bigger propeller 9. FIGS. 15-17 show examples of the different air streams or airflows 56 associated with small and large propellers.

The propeller 9 is a rotating mass, therefore it induces gyroscopic precession. The propeller 9 is subject to gyroscopic forces when the plane changes direction. The propeller 9 would normally tend to push the flying object downward in a turn to one side, and upward in a turn to the opposite side, depending on the direction of rotation of the propeller. This is the gyroscopic precession. As an example, the rotation of the propeller may push the front of the plane forward/down in a left turn. This may push the airplane to the ground because it continuously reduces the incidence of the airfoil.

The propeller 9 is placed in relation to the wing 30 in such a manner that the effects of the swinging motion of the propeller 9 towards the stability of any flying object 20 have been determined and taken account of. The propeller 9 is located to provide additional stabilization and to assume flight functions often used in existing flying objects, such as model flying objects. The weight of the propeller can also be varied depending on desired flight characteristics.

More details of the stabilizing surfaces and fins are set out. Apart from keeping a stable flight path in the vertical plane (up/down), the plane keeps its flight direction (left/right). Various surfaces and fins are applied (more or less vertical) to help the plane 'track' at high angles of incidence. The location and size of these surfaces and fins determine the degree to which this is realized.

The stabilizing surfaces and fins, both in front and backwards of the propeller contribute to this. Control surfaces can be integrated to allow left/right and up/down steering.

The disclosure embodies apparatus including a toy aircraft adapted to be launched and sustained in its flight path at least in part due to deflection of relative air flow, the aircraft comprising a wing generally of lightweight construction. The wing may be unswept, swept back, or forward swept.

One or more aspects of the wing form control surfaces that enable maneuvering. Maneuvering with the control surfaces may include, for example creating or deflecting the air flow with the control surface angled upwardly or downwardly relative to the direction of forward advancement for increasing or decreasing the flight altitude of the flying object. Such maneuvering also includes altering the air flow laterally with the control surface to cause the flying object to execute a turn.

The flying object is able to take off in short distances, for instance a distance of 50 cm, and may also be hand launched. The flying object is able to gently float or 'parachute' down when the forward flight force has been stopped, allowing for short and precise landings, for instance a distance of 30 cm or less. As a result, controlled flight of the flying object within small spaces, such as a home, becomes possible. Outdoor flight is also contemplated.

In another form of the disclosure, the control surface of the wing may have portions hingedly connected and supported to move up and down, and an actuator may be carried by a frame to which the wing sections are connected to displace them up and down.

In another format, the flying object comprises a body with a tail; a propeller with propeller blades which are driven by a propeller shaft on which the blades are mounted. The body includes landing gear elements 7 directed downwardly and partly forwardly of a longitudinal plane 27 the wing 30 of the flying object 20. The landing gear elements 7 are directed downwardly whereby the tips 44 and 46 of the landing gear elements 7 respectively permit for stabilizing the overall body of the flying object 20 when on the ground.

There is an upwardly directed fin 4*a* at the tail of the flying object 20. There is also a downwardly directed fin 4*b* at the tail of the flying object 20.

Figure 7:
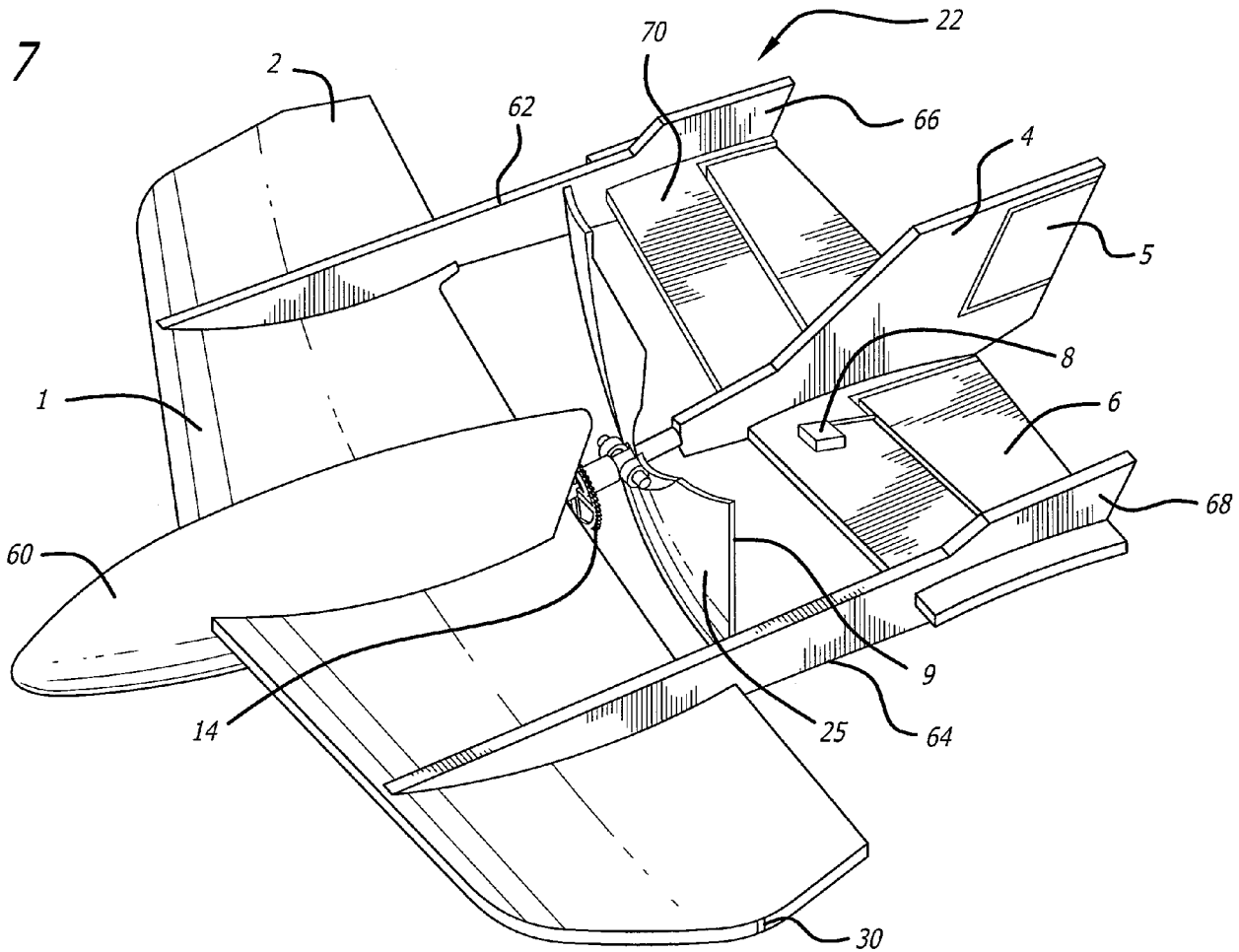
FIG. 7 is a top perspective view from the front showing the wing surface, fin and propeller of an alternative form of a flying object, a toy airplane.
Figure 8:
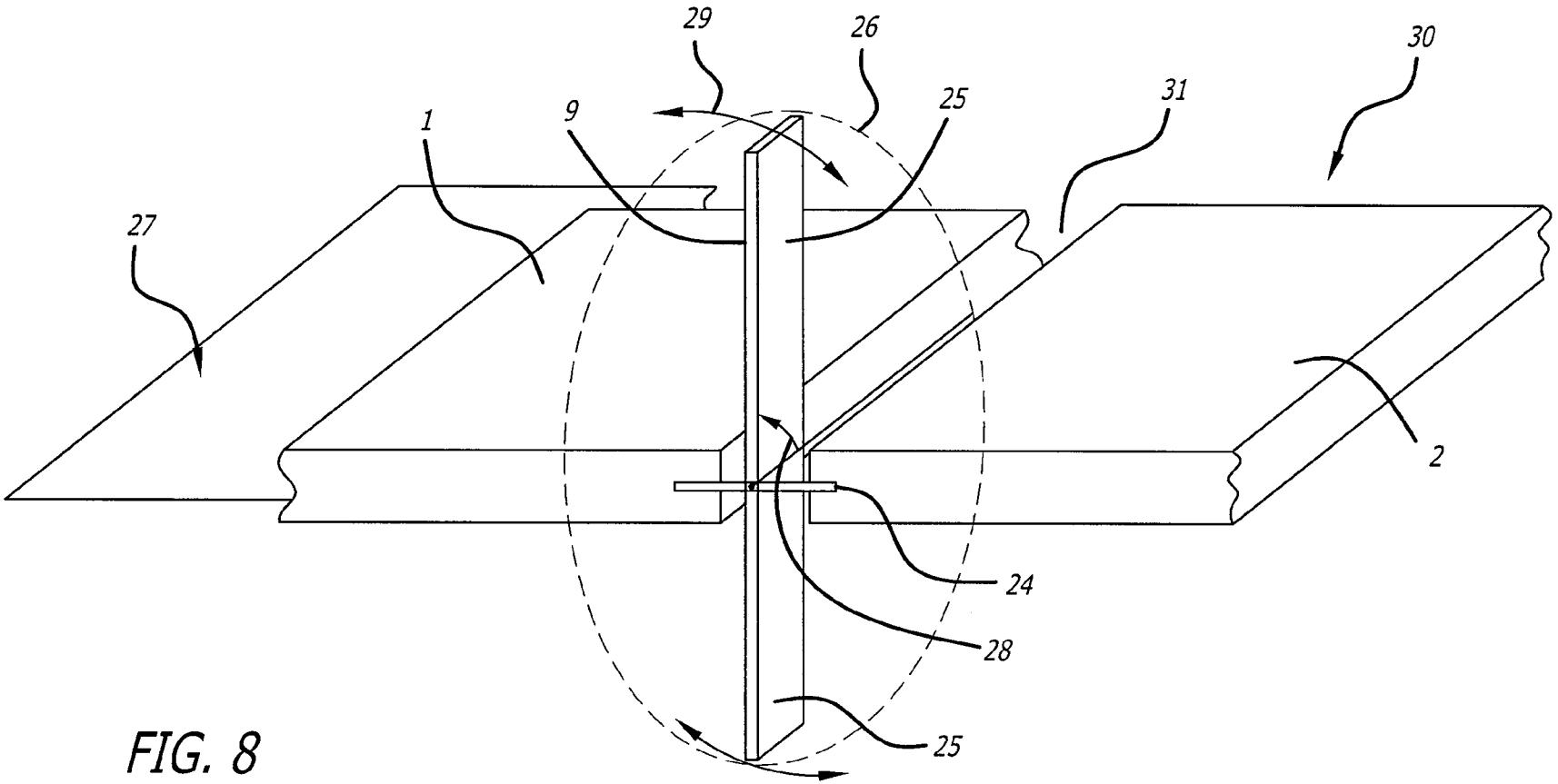
FIG. 8 is representative view showing the movable relationship of the propeller and the surface of the wing.

In the embodiment of FIG. 7 there is a configuration where wing 30 is separated. The part of the wing 30 in front of propeller 9 is the FEFS and the part of the wing 70 behind the propeller 9 is the BEFS. There are also fuselage directed body elements; a forward nose type central body 60 and two off center centrally formed mid body portions 62 and 64 that are connected at the rear ends 66 and 68 with the stabilizer 70 and the up/down control portions 6.

The operation of the flying object 20 is as follows.

In flight, the propeller 9 is driven at a certain speed, as a result of which a relative air stream or airflow is created in relation to the propeller 9. As a result of this, the propeller 9 generates a forward and upward force so as to make the flying object 20 rise or descend or maintain a certain height, and there can be a laterally force or thrust which can be generally created by the action of the propeller 9 for propulsion of the flying object 20.

Also, the movement of the directional control surface 5 as operated by a controller 60 can cause the direction of the flying object 20 to change as controlled. The controller 60 can interact with the controller 18.

In practice, the combination of different aspects makes it possible to produce a flying object 20 which is stable in any direction and any flight situation and which is easy to control, even by persons having little or no experience.

The present disclosure is not limited to the embodiments described as an example and represented in the accompanying figures. Many different variations in size, scope, and features are possible. For instance, instead of electrical motors being provided others forms of motorized power are possible. A different number of blades 25 may be provided to the propeller 9. In some cases there may be more than one propeller 9.

The flying object 20 is shown as having a broad planar wing 30 without a body or fuselage. However, a body may be used in some examples.

A flying object 20 can be made in all sorts of shapes and dimensions while still remaining within the scope of the disclosure. In this sense although the flying object in some senses has been described as toy or model flying object, the features described and illustrated can have use in part or whole in a full-scale flying object.

The flying object 20 can be a lightweight toy where the bottom surface 58 and top surface 60 of the wing 30 may be formed as a plane, a sheet or other object which is portable and typically carried by a human "user" or "pilot" 15 of the toy flying object.

The wing 30 may be molded from lightweight plastic material, such as styrene foam, of 1 to 2 lb./ft. or up to 3 lb./ft density, in the shapes illustrated. It has camber throughout its length, as indicated by sections 9-12 taken through the left section of the wing, the right section being the same. The outer shape or profile of the wing 30 can have different shapes for stability.

The performance and stability of the flying object 20 are achieved through predetermined width to length ratios of the individual flying objects. The lightweight and aerodynamic design of the flying objects of FIGS. 1-17 produces stable high performance flight at a very low airspeed, typically 1 to 2 m/s. The low speed and low mass makes this type of flying object ideal for operation indoors, and results in no damage to the flying object, furnishings or people, in the event of collision during flight. The low airspeed allows operation outdoors in calm wind conditions.

Outdoor operation can continue in higher wind conditions by hand launching in free flight. The high performance glide and aerodynamic stability qualities permit the flying object to be thrown or launched with a thread line or rubber band to heights of 20 to 30 feet from which the flying object will perform long, stable, straight or circling flights. Alternatively under power, the flight may be similar or more extensive.

The flying object can return to a stable slow speed flight position, in case of an unwanted disturbance of the flight conditions. Such disturbance may occur in the form of a gust of wind, turbulences, a mechanical load change of the body or the propeller, a change of position of the body as a result of an adjustment to the variation of the speed of the propeller blades of the propeller.

The flying object can be used without much training or much experience of a user or the pilot. It can be of a toy construction, or it can be for a more full size operational real flying object. The flying object can be unmanned and/or be a remote-controlled model flying object. In other cases where the flying object is a glider there may be no propeller nor controller.

Skills developed in observing and learning to control the flight path of these flying objects leads to a rapid progression of ability and understanding of the fundamental principles of flight. In practice, it appears that such an improved flying object is more stable and stabilizes itself relatively quickly with or without a restricted intervention of the user.

The speed of the propeller in the plane of rotation of the propeller and the propeller shaft may vary. Different speeds causes changes in the action of the flying object.

While the apparatus and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures.

In one alternative embodiment, the propeller is hingedly connected to the rotational axis, such that the tip to tip wing is mechanically uncoupled from the rotational axis of the propeller. The propeller 9 may be hinge-mounted 10 on a propeller shaft 24, such that the angle as shown by arrows 28 between the plane of rotation 26 of the propeller 9 and the propeller shaft 24 may freely vary. This variation is also shown at the tips areas of the propeller 9 by arrow 29.

This way, the gyroscopic precession is not transferred from the propeller 9 to the rotational axis or the airplane body, and the disturbing up/down effects are cancelled out. This allows for an automatic stabilization of the flying object. In the case of a two bladed propeller 9 a 'tip to tip' hinge works. In case of more blades on the propeller 9 the hinge would typically be of the 'cardan' type.

A hinge-mounted propeller may also allow the flying object 20 to fly in a substantially slow and stable manner during disturbing internal or external forces. If the wing 30 is pushed or urged out of balance due to any disturbance whatsoever, the propeller 9 may shift from its previous position of equilibrium to compensate, resulting in an auto-stabilizing effect.

The present disclosure includes any and all embodiments of the following claims.

The invention claimed is:

1. A flying object comprising:

a single wing wherein the wing has a leading edge and a trailing edge and an upper and a lower surface between the edges, and a portion between the leading edge and trailing edge, the upper surface having a curved shape such that from the leading edge of the upper surface towards a mid part of the upper surface there is a concave shape, and the lower surface having a curved shape such that from the leading edge of the lower surface towards the mid part of the lower surface there is a convex shape;

wherein there is a portion of inflection on the portion between the leading edge and trailing edge towards the mid part of the wing such that the upper surface is convex from the mid part to the trailing edge and the lower surface is concave from the mid part to the trailing edge;

wherein the upper surface has a transverse concave profile between opposite sides of the wing;

wherein the single wing has a width at the leading edge that is wider than the width at the trailing edge;

wherein there is a downwardly directed stabilizer on the lower surface, wherein the downwardly directed stabilizer includes a longitudinal axis and is mounted so that the longitudinal axis is at an angle relative to a centrally directed axis extending between the tip of the leading edge and the tip of the trailing edge.

2. A flying object as claimed in claim 1 wherein there is a single vertical stabilizing fin located towards the trailing end and wherein the single vertical stabilizing fin includes a directional control surface controllable by a remote control remote from the single wing.

3. A flying object as claimed in claim 1 including a transverse aperture in the wing and a propeller located in the aperture, the propeller for creating a propulsive force for flight, blades of the propeller turning in a plane transverse to a line between the leading edge and the trailing edge of the surface.

4. A flying object as claimed in claim 3 wherein the propeller causes air from the front of the flying object to be drawn over a front upper surface towards a mid upper surface and pushes air over the mid upper surface towards the trailing edge.

5. A flying object as claimed in claim 3 wherein the ratio between a rotational diameter of the propeller and a side to side span of the single wing is at least 0.5.

6. A flying object as claimed in claim 1 wherein there is a pair of landing gear located toward the leading edge and wherein the pair of landing gear raise the leading edge from a surface such that the leading edge is at a distance farther from the surface than the trailing edge.

7. A flying object comprising:

a single wing wherein the wing has a leading edge and a trailing edge and an upper and a lower surface between the edges, and a portion between the leading edge and trailing edge, a transverse aperture in the surfaces of the wing between the leading edge and the trailing edge, a propeller being located in the aperture, the propeller being for creating a forward thrust for flight, blades of the propeller turning in a plane transverse to a line between the leading edge and the trailing edge of the surface;

the upper surface having a curved shape such that from the leading edge of the upper surface towards a mid part of the upper surface there is a concave shape, and the lower surface having a curved shape such that from the leading edge of the lower surface towards the mid part of the lower surface there is a convex shape;

wherein there is a portion of inflection on the portion between the leading edge and trailing edge towards the mid part of the wing such that the upper surface is convex from the mid part to the trailing edge and the lower surface is concave from the mid part to the trailing edge;

wherein the leading edge being raised above the trailing edge;

wherein the upper surface has a transverse concave profile between opposite sides of the wing;

wherein the single wing has a width at the leading edge that is wider than the width at the trailing edge; and wherein there is a downwardly directed stabilizer on the lower surface, wherein the downwardly directed stabilizer includes a longitudinal axis and is mounted so that the longitudinal axis is at an angle relative to a centrally directed axis extending between the tip of the leading edge and the tip of the trailing edge.

8. A flying object as claimed in claim 7 wherein there is a single vertical stabilizing fin located towards the trailing end and wherein the single vertical stabilizing fin includes a directional control surface controllable by a remote control remote from the single wing.

9. A flying object as claimed in claim 7 wherein the propeller causes air from the front of the flying object to be drawn a front upper surface towards a mid upper surface and pushes air over the mid upper surface towards the trailing edge.

10. A flying object as claimed in claim 7 wherein the ratio between a rotational diameter of the propeller and a side to side span of the single wing is at least 0.5.

11. A flying object as claimed in claim 7 wherein there is a pair of landing gear located toward the leading edge of the single wing and wherein the pair of landing gear raise the leading edge from a surface such that the leading edge is at a distance farther from the surface than the trailing edge.

12. A flying object comprising:

a single wing, wherein the wing has a leading edge and a trailing edge and an upper and a lower surface between the edges, and a portion between the leading edge and trailing edge, the upper surface having a curved shape such that from the leading edge of the upper surface towards a mid part of the upper surface there is a concave shape, and the lower surface having a curved shape such that from the leading edge of the lower surface towards the mid part of the lower surface there is a convex shape;

wherein there is a portion of inflection on the portion between the leading edge and trailing edge towards the mid part of the wing such that the upper surface is convex from the mid part to the trailing edge and the lower surface is concave from the mid part to the trailing edge;

wherein the leading edge being raised above the trailing edge; wherein the upper surface has a transverse concave profile between opposite sides of the wing;

wherein there is a downwardly directed stabilizer on the lower surface, wherein the downwardly directed stabilizer includes a longitudinal axis and is mounted so that the longitudinal axis is at an angle relative to a centrally directed axis extending between the tip of the leading edge and the tip of the trailing edge, and wherein the single wing has a width at the leading edge that is wider than the width at the trailing edge.

13. A flying object as claimed in claim 12 wherein there is a single vertical stabilizing fin located towards the trailing end and wherein the single vertical stabilizing fin includes a directional control surface controllable by a remote control remote from the single wing.

14. A flying object as claimed in claim 12 including a transverse aperture in the wing and a propeller located in the aperture, the propeller for creating a propulsive force for flight, blades of the propeller turning in a plane transverse to a line between the leading edge and the trailing edge of the surface.

15. A flying object as claimed in claim 14 wherein the propeller causes air from the front of the flying object to be drawn over a front upper surface towards a mid upper surface and pushes air over the mid upper surface towards the trailing edge.

16. A flying object as claimed in claim 14 wherein the ratio between a rotational diameter of the propeller and a side to side span of the single wing is at least 0.5.

17. A flying object as claimed in claim 12 wherein there is a pair of landing gear located toward the leading edge of the single wing and wherein the pair of landing gear raise the leading edge from a surface such that the leading edge is at a distance farther from the surface than the trailing edge.

18. A flying object comprising:

a single wing body, wherein the wing has a leading edge and a trailing edge and an upper and a lower surface between the edges, and a portion between the leading edge and trailing edge, the upper surface having a curved shape such that from the leading edge of the upper surface towards a mid part of the upper surface there is a concave shape, and the lower surface having a curved shape such that from the leading edge of the lower surface towards the mid part of the lower surface there is a convex shape;

wherein there is a portion of inflection on the portion between the leading edge and trailing edge towards the mid part of the wing such that the upper surface is convex from the mid part to the trailing edge and the lower surface is concave from the mid part to the trailing edge;

wherein a pair of landing gear raise the leading edge from a surface such that the leading edge is at a distance farther from the surface than the trailing edge, when resting on the ground surface;

wherein the upper surface has a transverse concave profile between opposite sides of the wing;

wherein the single wing has a width at the leading edge that is wider than the width at the trailing edge;

wherein there is a downwardly directed stabilizer on the lower surface, wherein the downwardly directed stabilizer includes a longitudinal axis and is mounted so that the longitudinal axis is at an angle relative to a centrally directed axis extending between the tip of the leading edge and the tip of the trailing edge.

19. A remote control toy flying object comprising:

a single wing body, the body being essentially a light weight foam material, a motor and a battery for the motor, a receiver, the motor being controllable by a remote control unit remote from the single wing body, the remote control unit being for signaling the receiver, wherein the single wing body has a leading edge and a trailing edge and an upper and a lower surface between the edges, and a portion between the leading edge and trailing edge, the upper surface having a curved shape such that from the leading edge of the upper surface towards a mid part of the upper surface there is a concave shape, and the lower surface having a curved shape such that from the leading edge of the lower surface towards the mid part of the lower surface there is a convex shape;

wherein there is a portion of inflection on the portion between the leading edge and trailing edge towards the mid part of the wing such that the upper surface is convex from the mid part to the trailing edge and the lower surface is concave from the mid part to the trailing edge;

wherein a pair of landing gear raise the leading edge from a surface such that the leading edge is at a distance farther from the surface than the trailing edge, when resting on the ground surface;

wherein the upper surface has a transverse concave profile between opposite sides of the wing;

wherein the single wing has a width at the leading edge that is wider than the width at the trailing edge;

wherein there is a downwardly directed stabilizer on the lower surface, wherein the downwardly directed stabilizer includes a longitudinal axis and is mounted so that the longitudinal axis is at an angle relative to a centrally directed axis extending between the tip of the leading edge and the tip of the trailing edge.

* * * * *